US005873218A

United States Patent [19]

Kendig

[11] Patent Number: 5,873,218

[45] Date of Patent: Feb. 23, 1999

[54] PACKAGING SYSTEM CAPABLE OF VENTING STEAM WHILE REMAINING TAMPER RESISTANT AND METHODS RELATING THERETO

[75] Inventor: Terrance David Kendig, Newark, Del.

[73] Assignee: E. I. du Pont de Nemours and Company, Wilmington, Del.

[21] Appl. No.: 854,830

[22] Filed: May 12, 1997

Related U.S. Application Data

[63] Continuation-in-part of Ser. No. 646,195, May 7, 1996, abandoned, which is a continuation-in-part of Ser. No. 414,568, Mar. 31, 1995, abandoned.

[60] Provisional application No. 60/049,940, Jun. 24, 1996.

[51] Int. Cl.[6] ..... B65B 53/02

[52] U.S. Cl. ..... 53/442; 206/497; 426/114; 426/118; 426/396

[58] Field of Search ..... 53/442, 557, 127, 53/425; 206/497; 426/109, 113, 114, 118, 234, 244, 243, 395, 396

[56] References Cited

U.S. PATENT DOCUMENTS

| | | | |
|---|---|---|---|
| 2,649,392 | 8/1953 | Marshall | 154/83 |
| 2,754,959 | 7/1956 | McCarty | 206/45.33 |
| 2,762,720 | 9/1956 | Michel | 117/65 |
| 2,865,765 | 12/1958 | Allen | 99/154 |
| 2,975,931 | 3/1961 | Harrison | 220/24 |
| 3,017,729 | 1/1962 | Cheeley | 206/497 X |
| 3,034,271 | 5/1962 | Carpenter et al. . | |
| 3,092,246 | 6/1963 | Harrison et al. | 264/342 R |
| 3,133,387 | 5/1964 | Harrison | 264/230 |
| 3,261,140 | 7/1966 | Long et al. | 53/425 X |
| 3,324,625 | 6/1967 | Dulmage | 53/442 |
| 3,411,265 | 11/1968 | Carpenter et al. | 206/497 X |
| 3,491,510 | 1/1970 | Sternau . | |
| 3,508,380 | 4/1970 | Nakamura . | |
| 3,509,683 | 5/1970 | Sternau | 53/442 |
| 3,636,678 | 1/1972 | Maros et al. . | |
| 3,686,823 | 8/1972 | Perlman | 53/442 |
| 3,912,823 | 10/1975 | Kane | 426/129 |
| 4,036,362 | 7/1977 | Ullman | 53/442 X |
| 4,247,509 | 1/1981 | Talbot | 264/230 |
| 4,263,246 | 4/1981 | Mercer | 264/230 |
| 4,399,159 | 8/1983 | Guibert | 426/113 |
| 4,590,078 | 5/1986 | Umina | 426/113 |
| 4,876,843 | 10/1989 | Obrien et al. | 53/442 X |
| 5,179,819 | 1/1993 | Sukeyasu et al. | 53/442 |
| 5,230,914 | 7/1993 | Akervik | 206/497 X |
| 5,511,360 | 4/1996 | Bakker et al. | 53/442 |

FOREIGN PATENT DOCUMENTS

| | | | |
|---|---|---|---|
| 0156404 A1 | 10/1985 | European Pat. Off. | B65D 81/34 |
| 0409288 A2 | 1/1991 | European Pat. Off. | C08J 5/18 |
| 1060162 | 3/1967 | United Kingdom . | |
| 2137972 | 10/1984 | United Kingdom | B65D 51/16 |

OTHER PUBLICATIONS

PCT International Search Report for International application No. PCT/US 97/10888 (Applicant's file reference AD6372B) dated May 15,1988.

Japanese Patent Application Kokai 64–70310.

Mylar® HS Polyester Film Summary of Properties.

*Primary Examiner*—Linda Johnson

*Attorney, Agent, or Firm*—Patricia L. Kelly

[57] ABSTRACT

A method of packaging a product by heat shrinking a low gauge, low shrink force, polyester shrink film to a rigid container. The lidding film engages around the outside of the container, thereby protecting the contents and providing evidence of tampering. The packaged product can be heated and will generally vent steam, while maintaining tamper resistance.

12 Claims, 2 Drawing Sheets

PACKAGING SYSTEM CAPABLE OF VENTING STEAM WHILE REMAINING TAMPER RESISTANT AND METHODS RELATING THERETO

CROSS REFERENCE TO RELATED APPLICATION

This application is a continuation-in-part of provisional application No. 60/049,940, filed Jun. 24, 1996 (Attorney Docket No. AD-6372-P1), now abandoned, and prior application Ser. No. 08/646,195, filed May 7, 1996, and entitled Packaging System Capable of Venting Steam While Remaining Tamper Resistant and Methods Relating Thereto, now abandoned, which was a continuation-in-part of prior application Ser. No. 08/414,568, filed Mar. 31, 1995, and entitled Closed Container and Packaging Process, now abandoned.

BACKGROUND OF THE INVENTION

1. Field of the Invention

The present invention relates broadly to packaging having a lidding film, which is resistant to tampering. More specifically, the present invention is directed to a particular type of polyester shrink film in combination with a particular type of tray or similar-type food support to provide a packaging system capable of venting steam while remaining tamper resistant.

2. Discussion of the Related Art

Broadly speaking, consumers are very interested in having assurance that the packaged products they purchase have not been adulterated in some way. A need therefore exists for an effective and economical means for tamper resistant packaging comprising a lidding film. A further need often exists for such packaging to be tamper resistant even during (or after) subsequent warming or heating of the package contents, particularly when the package contents is a food.

U.S. Pat. No. 3,491,510 to Sternau and U.S. Pat. No. 3,508,380 to Nakamura show packaging machines which apply shrink film as a lidding to rigid containers.

SUMMARY OF THE INVENTION

The present invention is directed to a method of using a particular type of polyethylene terephthalate ("PET") film to provide an ovenable, tamper-resistant lidding for rigid trays (or similar-type containers). The trays can have one or more walls which is (are): 1. outwardly protruding; 2 ribbed; 3. embossed; 4. comprised of protrusions; and/or the like. Alternatively, the tray can have smooth vertical walls, provided at least a portion of the outer surface of the wall supports a material which tends to engage a film when contacted with the film; a preferred such material is an adhesive. The PET lidding films of the present invention engage the tray in such a way as to allow steam venting (from inside the container to the outside), while also ensuring a tamper resistant seal between the film and container (access to the food is not possible without tearing the film).

The PET lidding film of the present invention comprises at least about 80 wt % PET, more preferably at least about 90 wt % PET. The PET can be a homopolymer or copolymer of PET. A PET homopolymer is intended to mean a polymer substantially derived from the polymerization of ethylene glycol with terephthalic acid, or alternatively, derived from the ester forming equivalents thereof (e.g., any reactants which can be polymerized to ultimately provide a polymer of polyethylene terephthalate). A copolymer of PET is intended to mean any polymer comprising (or derived from) at least about 50 mole percent ethylene terephthalate, and the remainder of the polymer being derived from monomers other than terephthalic acid and ethylene glycol (or their ester forming equivalents).

The PET lidding shrink films of the present invention are further defined as:

1. being biaxially oriented in the range of about 5%–25% shrink factor, more preferably in the range of about 7–20% shrink factor; and 2. having a thickness in the range of 12–75 micrometers (more preferably 25–60 micrometers);

The film is designed to be used with open rigid containers, particularly trays.

Relative to conventional shrink film, the shrink films of the present invention are advantageous for a number of reasons, including the following.

1. The PET shrink film is tough relative to many conventional shrink films, and the film's relatively small amount of orientation ("low shrinkage") has been found to better accommodate protrusions, by not shrinking to such an extent as to risk puncturing and by not shrinking to such an extent as to agglomerate an ugly mass of shrunken film around the protrusion.

2. The thin gauging of the shrink film (in combination with the low shrinkage), causes the lidding film to tear when the package is opened, thereby creating tamper evidence. Conventional shrink films will generally shrink to a much greater film thickness, thereby providing a lidding which can be pulled off without tearing (i.e., no tamper evidence).

3. Surprisingly, when first shrunk to the package, the films of the present invention form a tight conforming seal. However, due to the thin gauging and low shrinkage, the seal will become self venting when heated in an oven or the like. Conventional shrink films will either form a tight conforming seal or be self venting, but generally cannot do both.

4. The thin gauge, low shrink force films of the present invention provide excellent appearance and are generally more economical to use than conventional (higher gauge, higher shrinking) shrink films.

In use, the film is cut to size, (draped over the opening and) draped over the outer wall(s) of the tray by at least about 2 centimeters. The film is then held in place by a mechanical device, vacuum or the like. Heat is then applied to the sides of the container, thereby causing the film to shrink around the perimeter of the tray; this securely engages the film to the rigid container (e.g., tray). Thereafter, the film can be shrunk along its center portion to further tighten the film and eliminate wrinkles or the like.

The films of the present invention are well suited for the above described lidding method, because the film, once shrunk, is substantially non-elastomeric. As a result once applied, the film cannot be partially removed then replaced, but rather, to obtain access to the packaged product, the film must be torn. If the film is not torn, then the consumer can be assured that the product has not been previously opened or tampered with after packaging.

The films of the present invention are also advantageous, because they are sufficiently heat resistant to be ovenable. The film tightly seals around the tray (or other rigid container), but not so tightly (during oven heating or the like) as to prevent venting. Hence, steam from the heated food within the container can vent, while a tamper resistant seal is still maintained.

Furthermore, the films of the present invention will not leave a residue upon the container. This is particularly beneficial when reusable rigid containers are used, since there is no residue to be washed off the tray or similar-type rigid container.

The films of the present invention also provide a relatively small amount of shrinkage, relative to conventional shrink films, while still providing the sealing/lidding advantages of a shrink film. This makes the film simple and easy to use.

DETAILED DESCRIPTION OF THE PREFERRED EMBODIMENT(S)

Figure 1:
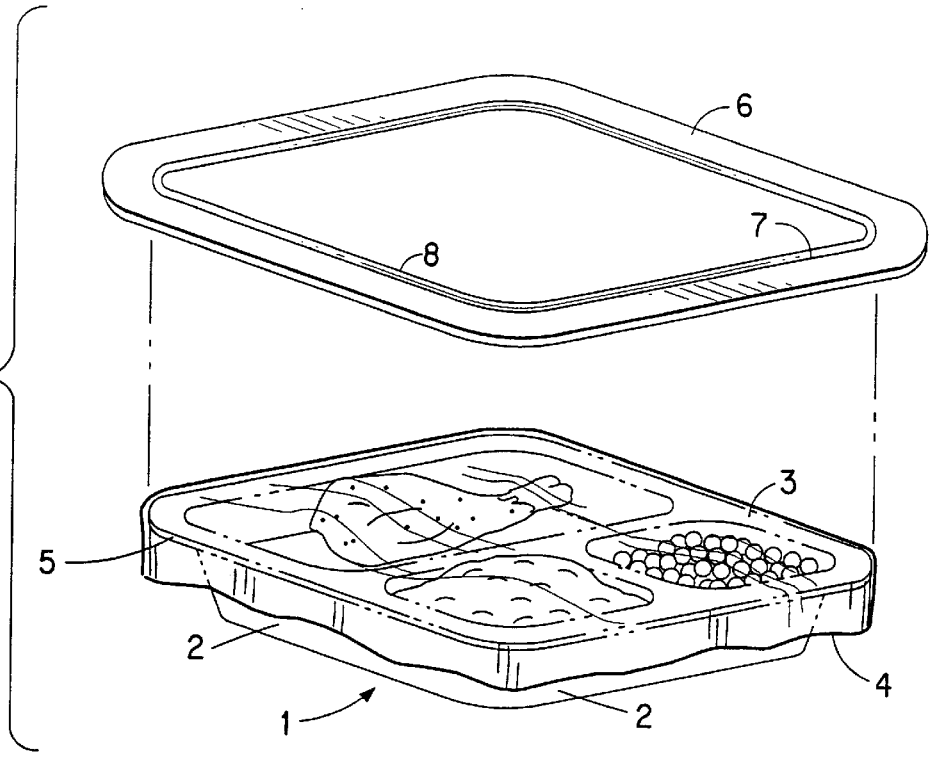
FIG. 1 is a perspective view of a container prepared in accordance with the present invention, prior to shrinking the sides of the film cover.

The present invention is applicable to the sealing/lidding of containers for foodstuffs, particularly containers which are designed to be reused. Such containers can be metal or can be prepared by thermoforming or molding polymeric material, such as, polycarbonate, polyester and polyamide. The polymeric material can further comprise reinforcing fillers, such as, fiberglass.

A preferred container comprises a wall which extends away from the center of the tray. The wall design can vary widely, but should be sufficient to retain the heat shrinkable film on the sides of the container, when the film on top of the container is being shrunk (first along the sides, then on top).

The shrink films of the present invention preferably have an orientation in each direction in the range of about 5% to about 25%, more preferably from about 7–20%. Many commercially available heat shrinkable polyethylene terephthalate films have an orientation from about 40 to 50% or more, and such shrink films would be unsuitable for use in the present invention. The thickness of the covering film is preferably in the range of about 12–75 micrometers, more preferably about 25–60 micrometers. Suitable polyethylene terephthalate shrink films are available from E. I. du Pont de Nemours and Company under the trademark Mylar® LD.

In use, the heat-shrinkable film is placed over the top of the container. Sufficient draping or overlap of the heat-shrinkable film should be provided to anchor the film after shrinking below the top surface of the container. The maximum overlap is not critical, so long as the overlap does not substantially exceed the depth of the sides of the container after shrinkage. The size of the film before shrinkage can be adjusted, according to the known shrink characteristics of the film. In general, a final overlap of about from 1 to 7 centimeters is satisfactory.

Preferably, the film is then restrained on the container. The film can be restrained on the top alone, as with a platen, or on the sides, or both. The restraining mechanism can vary widely and can include, for example, positive air pressure, vacuum, mechanical fingers or gasketing. Rubber gasketing, particularly silicone rubber, has been found to be particularly satisfactory for restraining the sides. The gasketing can be fastened to the inside of a frame or plate having an aperture formed therein which can pass over the top surface of the container.

While the film is restrained on the container, the film is heated to a temperature above the shrinkage temperature and below the melting temperature of the heat shrinkable film. The heating means can vary widely, and can include, for example, heated fluid or radiant heat. The film is preferably heated by the use of a heated fluid. This fluid can for example, be water or gas, air being preferred for convenience and economy. In any case, the fluid should be heated to above the shrinkage temperature of the heat-shrinkable film.

Preferably, the film is heat shrunk along the sides of the container prior to heat shrinking the film along the top of the container. In this way, the film along the sides will shrink around the edge of the container and anchor the periphery of the top portion of film to the container. The top portion of the film can then be heat shrunk, thereby removing any wrinkles and providing a neat, taut lidding surface along the top of the container. Such sequential shrinking of the film can be accomplished by protecting the top surface of the container with a platen, while the sides are exposed to either heated fluid or a shrink tunnel; the platen can then be removed, allowing the top portion of the film to then be heat shrunk.

The heated fluid can be generated in an number of conventional or non conventional ways. For example, conventional air heat guns can be used to heat the film, and the air temperature can be controlled by resistance temperature detectors (RTDs) incorporated into the heat gun. Circumferential or perimetric tubes can be used to direct the heated air along the sides of the container. The heated air flow can also be used to restrain the film by impinging upon the film along the sides of the container. In such an embodiment, perimetric tubing can be made to conform to the shape of the container, and fitted to receive a heat gun.

The heating mechanism can vary widely, depending upon the size of the container and the desired speed of operation. A 220 voltage, 2000 watt heat gun has been found to generate adequate flow of heated fluid for average sized food containers to be packaged in accordance with the present invention. The heat gun can be controlled by a PID microprocessor temperature controller and an RTD (resistance temperature detector) sensing device. The RTD changes electrical resistance with changes in temperature and can thereby signal the temperature controller to adjust the electrical current, as needed for maintaining a constant temperature.

The precise nozzle location for the heated air can be adjusted to the particular configuration of the container being covered. For example, the hot air pipe can be above the top of the container with the nozzles directed to a point below the top of the container, thereby shrinking the draped and restrained film along the sides of the container.

The temperature for heat shrinking the material across the top can similarly vary widely, and (as with the shrinkage of the film along the sides of the package) will be above the shrinking temperature of the film, but below its melting temperature. Fluid temperatures above the melting temperatures of the film can be used to shrink the film provided appropriate adjustment to the exposure time is made, so the film does not melt. Similarly, the shrinking of the top of the film can be accomplished with a heated air gun, fitted with a nozzle appropriate to the size and shape of the package being treated.

The heat shrinkable film to be used is generally cut to a size that will overlap or drape over the top of the container to be lidded by at least about 1 centimeter on each side of the container after shrinkage. Depending on the sequence of shrinkage, and the particular apparatus used, the heat-shrinkable film can be cut to size before heat-shrinking, simultaneous with heat-shrinking, or after heat-shrinking.

The present invention will be further understood by reference to the drawings, in which FIG. 1 is a perspective view of a container 1 having side walls 2. In the embodiment shown in the Figures, side walls 2 are provided with outwardly turned flanges 3. Although a flanged tray such as is shown is preferred, it is to be understood that the invention is not limited to the use of such a tray. The container is subdivided, for example, for various portions of foods. A heatshrinkable film 4 is cut to a size greater than the outer dimensions of the container top. The film is retained below the top of the container along container sides 5 by frame 6 having interior edge 7 to which gasket 8 is attached. The inner edge of the gasket is somewhat smaller than the outer perimeter of the container top, to permit the frame with the gasket to be installed over the top of the container. Heated fluid, such as air, can be directed to the film edge below the perimeter of the container top, thus shrinking the film and anchoring the film over the container.

Figure 2:
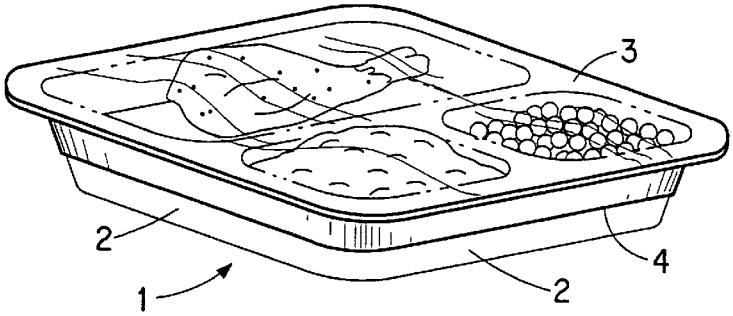
FIG. 2 is a perspective view of a container prepared in accordance with the present invention after shrinking the sides of the film cover, and before shrinking the top of the cover.
Figure 3:
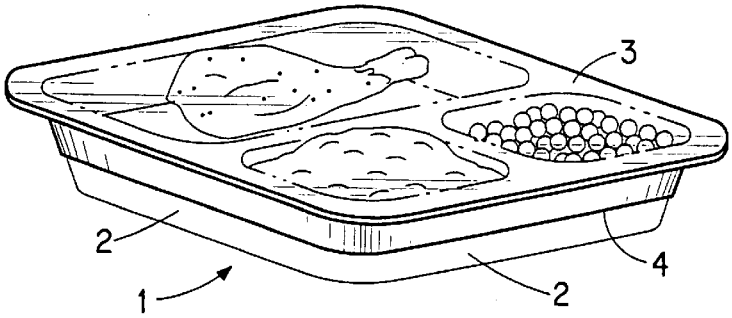
FIG. 3 is a perspective view of a sealed container prepared using the present invention.

FIG. 2 illustrates the container after heat shrinking the sides of the film, in which the shrunk film is tightly anchored around the side walls 2 of the container. At this point, heated fluid can be applied to the film on the top of the container, shrinking that portion and resulting in a tightly sealed package as shown in FIG. 3. With sequential shrinking of the film, the restraining means is typically removed prior to shrinking the film on the top of the container.

While a sequential shrinking of the film around the package is preferred, as described above, the entire film can be shrunk simultaneously with an appropriately sized platen for the heated fluid.

Figure 4:
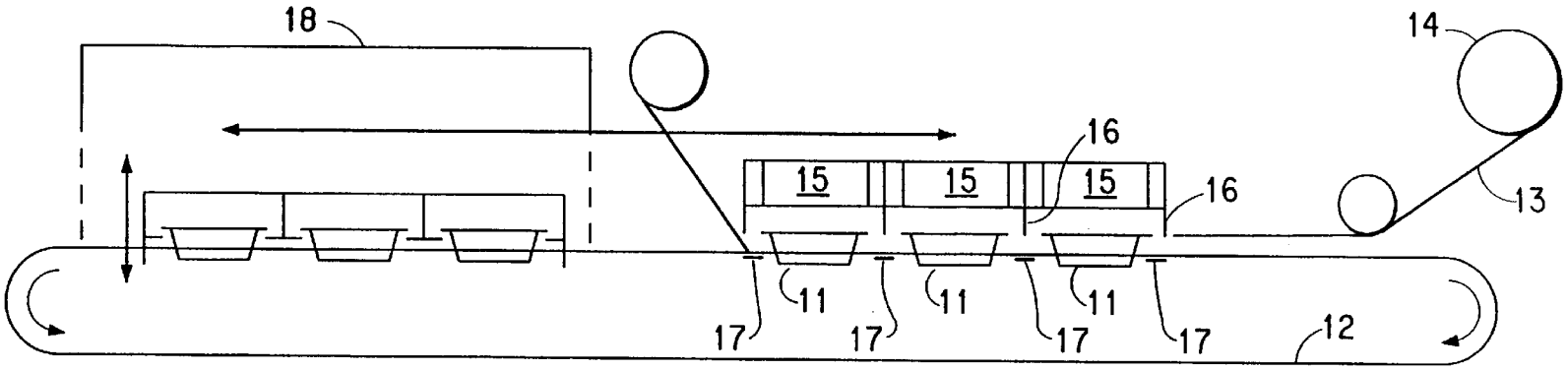
FIGS. 4 and 5 are schematic cross-sectional views of an apparatus in accordance with the present invention.
Figure 5:
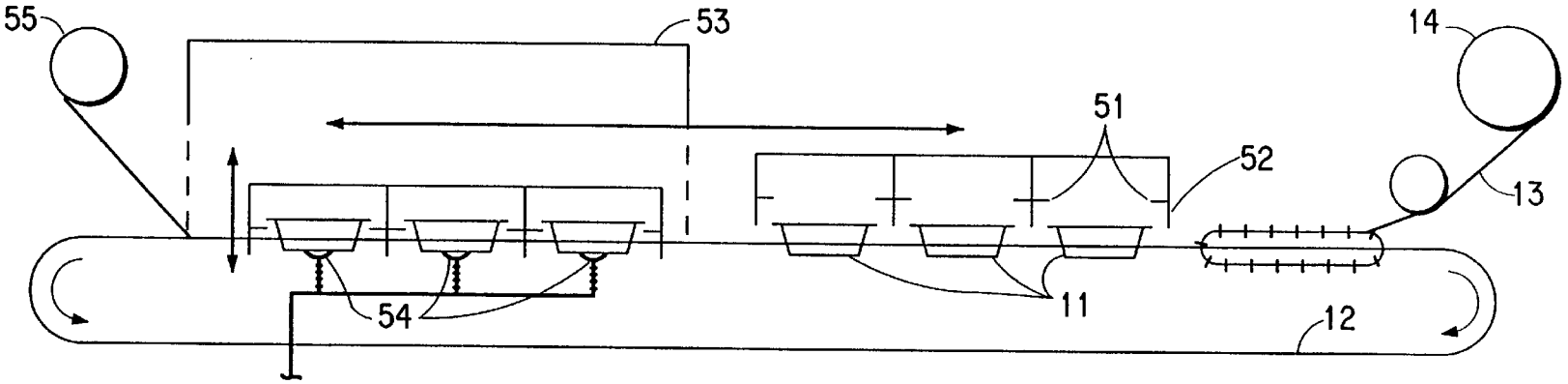

FIGS. 4 and 5 are schematic illustrations of representative apparatus that can be used in accordance with the present invention.

In FIG. 4, trays 11, positioned on conveyor 12, are capped with film 13 supplied by roll 14. The film is held in place on top of each of the containers by platens 15 and the edges of the film cut by die-cutters 16. The sides of the film are then shrunk using hot air through heat guns 17. Hereafter, the trays are moved into a shrink tunnel 18, in which the tops of the containers are shrunk.

An alternative apparatus which can be used in accordance with the present invention is shown in FIG. 5. There, trays 11, on conveyor 12, are similarly capped with film 13 supplied from roll 14. However, the edges of the film are held in place around the tops of the containers by tucking means 51, and die-cut by blades 52. With the sides thus restrained, the trays with the tucking or restraining devices in place are moved to shrink tunnel 53, where they are held in place by vacuum holding devices 54, applied to the bottom of each container. In this apparatus the heat-shrinkable films on the side and the tops of the containers are shrunk simultaneously in the shrink tunnel. Waste heat-shrinkable film is rewound on roll 55.

The heat-shrunk polymeric film can be readily removed from the sides and top of the container, by removing with an exposed edge or tearing the top. An appropriate notch, tear tab or peel tab can also be provided as desired.

The heat-shrunk polymeric film on the top of the container, conforming closely, as it does, to the sides of the container, hinders tampering with the contents such as foodstuffs. This is particularly important, for example, in prison environments, where concern for tampering with supplied foods is high. At the same time, while the cover hinders tampering of the food, it permits venting of the overall package during cooking or reheating, since the heat-shrunk cap of the polymeric film, being substantially free from sealant along the edge, permits the escape of expanding gases that would otherwise condense on the inner surface of the cover or cause rupture of the cover or the seal.

The containers are, after use, substantially free from sealant residue, since no adhesive is used for the cover, and the polymeric film is not heat sealed to the edge or lip of the container. This substantial absence of sealant or sealant residue from the container facilitates reuse of the container without scouring or the use of strong solvents.

In a preferred embodiment, the tray is washable and re-usable; a preferred such tray is metal or rigid plastic. A preferred method of use includes: 1. preparing a meal on the tray; 2. draping a low gauge, low shrink force PET film over the meal and over the sides of the tray; 3. shrinking the film, thereby causing the film to form a tight conforming seal around the entire periphery of the tray; 4. transporting the combination to an institution; 5. heating the combination at the institution without disrupting the film engagement with the tray; 6. providing the combination to a person desiring the meal who checks to see that the film is in place and untorn (no tampering), and then tears open the film and enjoys the meal; and 7. finally, the tray is reclaimed, washed and sent out to be used all over again, starting with step 1 above.

The present invention is further illustrated by the following examples.

EXAMPLES 1–3

A rectilinear molded container for foodstuffs having approximate dimensions of 6¼" by 8½" by 2" (15.9 cm by 21.6 cm by 5.1 cm) deep was lidded using heat shrinkable polyethylene terephthalate films having a thickness of about 19 microns, and a shrinkage of 45%, 20% and 9%. Each film was cut to a size about 45% greater than each dimension of the top surface on each side of the container. The film was held in place below the flange by a frame having a gasket on the inner surface of the frame.

The trays contained a wooden block with two nails protruding about 2.6 centimeters above the tray flange. The first tray was lidded with a shrink film biaxially oriented about 45%. The second tray was lidded with a shrink film biaxially oriented about 20%, and the third tray was lidded with film biaxially oriented about 9%. The film was first shrunk around the sides by the application of air through a nozzle, heated to a temperature above the shrink temperature of the film and below its melting temperature, after which the restraining gasket was removed. Thereafter, the film on the top of the container was shrunk with the same air source by consecutive passes of the nozzle over the top of the film. After lidding film application and placement in a 350° F. (177° C.) oven for about 20 minutes, the following results were obtained.

Tray 1 (45% biaxial orientation PET lidding shrink film): No film punctures, but film shrunk up over the sides and away from the tray flange, eliminating tamper resistance and causing a 2.6 centimeter band of wrinkles on the tray sides, due to excessive shrinkage. The film did not tear upon removal. The film wrinkled along the sides of the tray.

Tray 2 (20% biaxial orientation PET lidding shrink film): No punctures, and film remains anchored tightly around and under the entire tray flange. The lidding film provided tamper resistance by tearing during an attempt to lift the film away from the tray flange. Far less wrinkling at the sides, relative to Tray 1 discussed above.

Tray 3 (9% biaxial orientation PET lidding shrink film): No punctures, the lidding film seals tightly around and under the entire tray flange. The lidding film surface was smooth all around the tray (no wrinkles). The lidding film provided tamper resistance by tearing during an attempt to lift the film away from the tray flange.

EXAMPLE 4

Trays of different compositions where tested with lidding film having biaxial orientation of 45% and 20% shrinkage. The 45% biaxial oriented shrink film produced unwanted tray distortion and the 20% biaxial oriented shrink film produced no significant tray distortion for the following tray materials: aluminum foil and crystalline polyethylene terephthalate.

I claim:

1. A tamper-resistant packaging container capable of venting vapor comprising, in combination:

a) an open rigid container having a floor portion and side walls upwardly extending therefrom;

b) a heat-shrink lidding film in intimate contact with at least a portion of an outer surface of said side walls, said heat-shrink lidding film comprising at least 80% by weight polyethylene terephthalate polymer; and wherein:

i) said film has a thickness in the range of 12–75 micrometers, ii) said film is biaxially oriented in the range of about 5% to about 25% shrink factor; and iii) said film remains in tamper resistant engagement with said container, securely sealing said container without hermetically sealing said container, allowing air and moisture to vent out of said container.

2. The packaging container of claim 1, wherein the heat-shrink film is biaxially oriented in the range of about 7% to about 20% shrink factor, and wherein the heat-shrink film has a thickness between 25 and 60 micrometers.

3. The packaging container of claim 1, wherein said side walls of said rigid container further comprise outwardly turned flange members.

4. The packaging container of claim 1, further comprising an adhesive in contact with at least a portion of an outer surface of said side walls to facilitate adhesion between the side walls of the container and the heat-shrink film.

5. A method of packaging a product, comprising:

a) placing a product within an open rigid container, said container comprising a floor portion and side walls extending upward therefrom;

b) placing a heat-shrink film over said container, whereby at least a portion of said film is in contact with at least a portion of an exterior surface of said side walls, wherein:

i) said film comprises at least 80 percent by weight of a polyethylene terephthalate homopolymer or copolymer, ii) said film has a thickness of 12–75 micrometers, and iii) said film is biaxially oriented in the range of about 5%–25% shrink factor;

c) heating the sides of the film thereby causing the film to shrink and securely seal around the container without hermetically sealing said container, allowing air and moisture to vent out of said container.

6. The method of claim 5, wherein the heat-shrink film is biaxially oriented in the range of about 7–20% shrink factor and wherein the film has a thickness between 25 and 60 micrometers.

7. The method of claim 5, wherein said walls of said rigid container further comprise outwardly turned flange members.

8. The method of claim 5, further comprising the step of applying an adhesive to a portion of an exterior surface of the side walls of the rigid container in contact with said film to facilitate adhesion between the side walls and the heat-shrink film.

9. The packaging container of claim 1, wherein said lidding film is torn or ruptured, indicating package removal or tampering has occurred, when said container is no longer securely sealed and said film is removed from the sealing position.

10. The method of claim 5, further comprising:

d) heating the product while the film is securely sealed around the container and remains in tamper resistant engagement with the container, thereby causing an amount of heated air or moisture vapor to vent out of the container without tearing the film and without diminishing the tamper resistant engagement between the film and the container.

11. The method of claim 5, wherein the rigid container is a washable, re-usable tray.

12. The method of claim 5, wherein a portion of the product protrudes beyond the rigid container and is compressed against the lidding film as the film is heated and securely sealing the container.

* * * * *

UNITED STATES PATENT AND TRADEMARK OFFICE

CERTIFICATE OF CORRECTION

PATENT NO. : 5,873,218

DATED : February 23, 1999

INVENTOR(S) : Terrance David Kendig

It is certified that error appears in the above-identified patent and that said Letters Patent is hereby corrected as shown below:

Claim 7, Column 8, line 20:
After "wherein said" add --side--

Signed and Sealed this

Nineteenth Day of December, 2000

*Attest:*

*Attesting Officer*

Q. TODD DICKINSON

*Commissioner of Patents and Trademarks*